US011105549B2

(12) United States Patent
Brooke et al.

(10) Patent No.: US 11,105,549 B2
(45) Date of Patent: Aug. 31, 2021

(54) REFRIGERATOR APPLIANCE WITH A CONVERTIBLE COMPARTMENT

(71) Applicant: Haier US Appliance Solutions, Inc., Wilmington, DE (US)

(72) Inventors: Richard Dana Brooke, Louisville, KY (US); Christopher J. Schweiger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 159 days.

(21) Appl. No.: 16/159,797

(22) Filed: Oct. 15, 2018

(65) Prior Publication Data

US 2020/0116418 A1 Apr. 16, 2020

(51) Int. Cl.

| | |
|---|---|
| ***F25D 11/02*** | (2006.01) |
| ***F25D 23/02*** | (2006.01) |
| ***F25D 17/06*** | (2006.01) |
| ***F25D 17/04*** | (2006.01) |

(52) U.S. Cl.

CPC ..... *F25D 23/026* (2013.01); *F25D 11/02* (2013.01); *F25D 17/045* (2013.01); *F25D 17/065* (2013.01); *F25D 2700/123* (2013.01)

(58) Field of Classification Search

CPC ..... F25D 11/02; F25D 17/045; F25D 17/065; F25D 2700/123; F25D 23/068; F25D 23/069; F25D 2400/16

USPC ..... 62/447

See application file for complete search history.

(56) References Cited

U.S. PATENT DOCUMENTS

| | | | | |
|---|---|---|---|---|
| 7,966,842 | B2 * | 6/2011 | Kamisako | F25D 17/042 62/373 |
| 8,074,469 | B2 | 12/2011 | Hamel et al. | |
| 9,140,472 | B2 * | 9/2015 | Shin | F25D 17/065 |
| 9,897,370 | B2 * | 2/2018 | Gillette | F25D 25/025 |
| 9,908,386 | B2 * | 3/2018 | Trutnovsky | B60H 1/00849 |
| 10,451,337 | B2 * | 10/2019 | Lee | F25D 11/02 |
| 2003/0010056 | A1 * | 1/2003 | Sakamoto | F25D 17/08 62/441 |
| 2008/0271475 | A1 * | 11/2008 | Wuesthoff | F25D 17/065 62/447 |
| 2008/0314054 | A1 * | 12/2008 | An | F25D 17/065 62/179 |
| 2009/0113923 | A1 * | 5/2009 | Young | F25D 17/065 62/441 |

(Continued)

FOREIGN PATENT DOCUMENTS

| | | | |
|---|---|---|---|
| CA | 2535245 | A1 | 9/2006 |
| EP | 2789937 | A1 | 10/2014 |

*Primary Examiner* — Filip Zec

(74) *Attorney, Agent, or Firm* — Dority & Manning, P.A.

(57) ABSTRACT

A refrigerator appliance includes a cabinet defining multiple food storage chambers which are operable at distinct temperatures. The refrigerator appliance includes a cabinet comprising a plurality of insulated mullions. The insulated mullions at least partially define a fresh food chamber, a freezer chamber, a convertible chamber, and a plenum. The refrigerator appliance also includes a first damper selectively providing fluid communication between the fresh food chamber and the plenum, a second damper selectively providing fluid communication between the freezer chamber and the plenum, and a fan disposed between the convertible chamber and the plenum. The fan is configured to force air from the plenum into the convertible chamber.

14 Claims, 5 Drawing Sheets

(56) References Cited

U.S. PATENT DOCUMENTS

| | | | | |
|---|---|---|---|---|
| 2010/0162747 | A1* | 7/2010 | Hamel | F25D 17/065 62/441 |
| 2017/0167780 | A1* | 6/2017 | Jeong | F25D 23/062 |

* cited by examiner

REFRIGERATOR APPLIANCE WITH A CONVERTIBLE COMPARTMENT

FIELD OF THE INVENTION

The present subject matter relates generally to refrigerator appliances, and more particularly, to refrigerator appliances having convertible compartments.

BACKGROUND OF THE INVENTION

Certain refrigerator appliances utilize sealed systems for cooling chilled chambers of the refrigerator appliances. A typical sealed system includes an evaporator and a fan. The fan generates a flow of air across the evaporator to cool the flow of air. The cooled air is then provided through an opening into the chilled chamber to maintain the chilled chamber at a desired set point temperature. Air from the chilled chamber is circulated back through a return duct to be re-cooled by the sealed system during operation of the refrigerator appliance, maintaining the chilled chamber at the desired temperature.

Certain refrigerators appliances include multiple freezer compartments configured for maintaining different temperatures for storing different types of food and drink items. For example, a conventional quad door bottom mount refrigerator can include a freezer chamber having two separate freezer compartments that are maintained at different temperatures. More specifically, a first freezer compartment may be maintained at a conventional freezer temperature (e.g., around 0° F.), while a second "convertible" freezer compartment may be adjusted between a conventional freezer temperature and relatively warm temperatures.

However, achieving different temperatures in each of the compartments of such refrigerator appliances typically requires a separate evaporator for each compartment. In this regard, a single compressor may drive refrigerant through a four-way valve to an evaporator configured for cooling a single compartment at a time. However, additional evaporators result in added costs, more complicated assembly, and a more complex refrigerant plumbing configuration. In addition, a four-way valve may be required or operational limitations may arise, e.g., only a single compartment may be cooled at a single time due to the shared compressor. Additionally, conventional refrigerator appliances typically include electric heaters for warming the convertible compartment to the desired set point temperature. Such electric heaters can be detrimental to energy performance.

Accordingly, a refrigerator appliance including a convertible compartment which can be conditioned without requiring an additional evaporator dedicated to the convertible compartment would be useful.

BRIEF DESCRIPTION OF THE INVENTION

Aspects and advantages of the invention will be set forth in part in the following description, or may be apparent from the description, or may be learned through practice of the invention.

In one exemplary aspect, a refrigerator appliance is provided. The refrigerator appliance defines a vertical direction, a lateral direction, and a transverse direction. The vertical, lateral, and transverse directions are mutually perpendicular. The refrigerator appliance includes a cabinet extending from a top to a bottom along the vertical direction, from a left side to a right side along the lateral direction, and from a front side to a rear side along the transverse direction. A fresh food chamber is defined in the cabinet. The fresh food chamber extends along the vertical direction between the top and the bottom of the cabinet and along the lateral direction between the left and right sides of the cabinet. A freezer chamber is also defined in the cabinet. The freezer chamber extends along the vertical direction between the top and bottom of the cabinet and along the lateral direction between the left and right sides of the cabinet. The freezer chamber is spaced apart from the fresh food chamber along the vertical direction. A convertible chamber is defined in the cabinet. The convertible chamber extends along the vertical direction between the top and bottom of the cabinet and along the lateral direction between the left and right sides of the cabinet. The convertible chamber is spaced apart from the fresh food chamber along the vertical direction and spaced apart from the freezer chamber along the lateral direction. A plenum is also defined in the cabinet. The plenum is aligned with the convertible chamber along the vertical and lateral directions and spaced from the convertible chamber along the transverse direction. A first damper selectively provides fluid communication between the fresh food chamber and the plenum. A second damper selectively provides fluid communication between the freezer chamber and the plenum. A fan is disposed between the convertible chamber and the plenum. The fan is configured to force air from the plenum into the convertible chamber.

In another exemplary aspect, a refrigerator appliance is provided. The refrigerator appliance includes a cabinet comprising a plurality of insulated mullions. The insulated mullions at least partially define a fresh food chamber, a freezer chamber, a convertible chamber, and a plenum. The refrigerator appliance also includes a first damper selectively providing fluid communication between the fresh food chamber and the plenum, a second damper selectively providing fluid communication between the freezer chamber and the plenum, and a fan disposed between the convertible chamber and the plenum. The fan is configured to force air from the plenum into the convertible chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
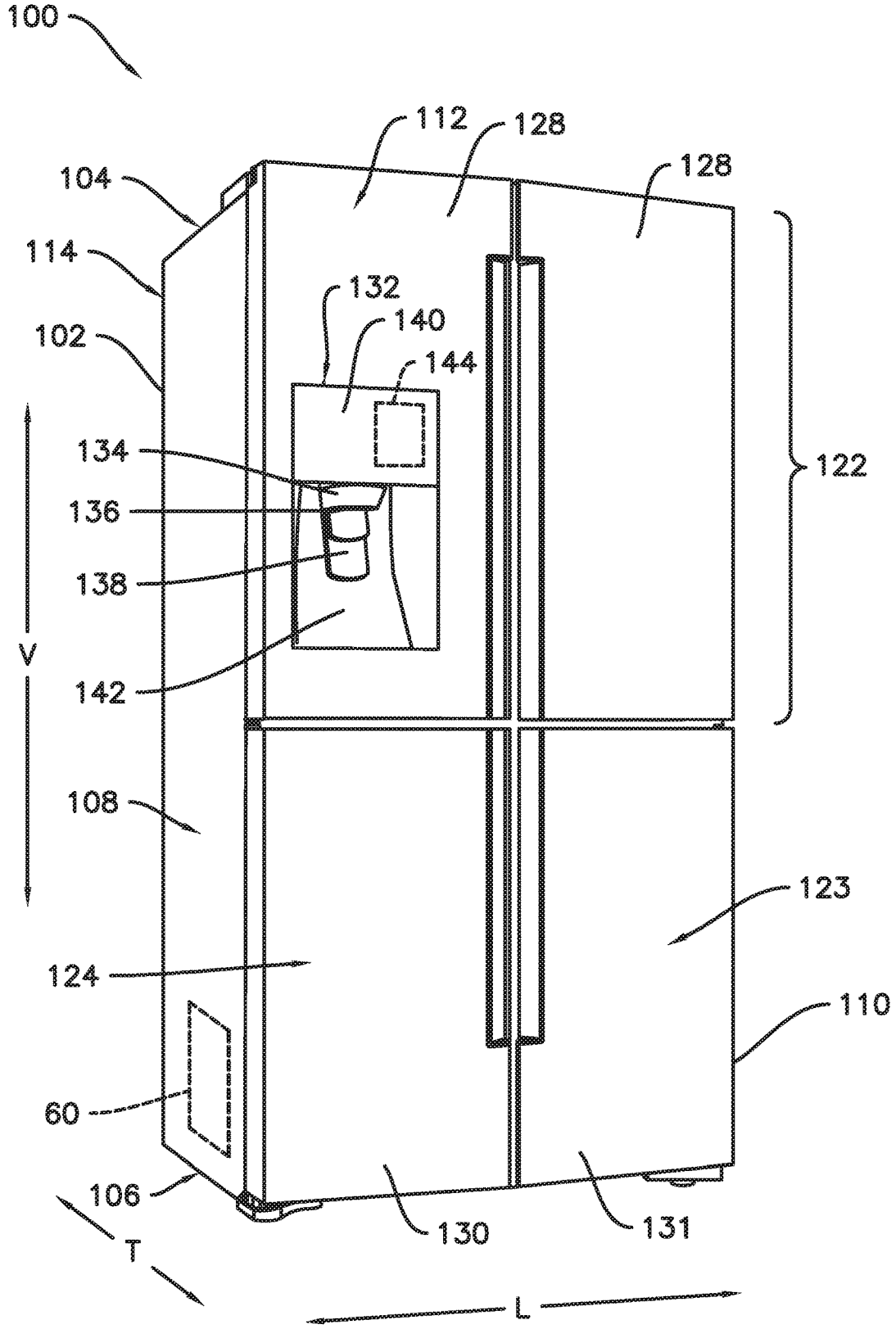
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

FIG. 1 provides a perspective view of a refrigerator appliance 100 according to an exemplary embodiment of the present subject matter. Refrigerator appliance 100 includes a housing or cabinet 102 that extends between a top 104 and a bottom 106 along a vertical direction V, between a left side 108 and a right side 110 along a lateral direction L, and between a front side 112 and a rear side 114 along a transverse direction T. Each of the vertical direction V, lateral direction L, and transverse direction T are mutually perpendicular to one another and form an orthogonal direction system.

Cabinet 102 defines chilled chambers for receipt of food items for storage. In particular, cabinet 102 defines fresh food chamber 122 positioned at or adjacent top 104 of cabinet 102 with a freezer chamber 124 and a convertible chamber 123 arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. As another example, although the illustrated example embodiment depicts the freezer chamber 124 on the left side and the convertible chamber 123 on the right side, it is recognized that such configuration is provided by way of example only and not limitation, e.g., the freezer chamber 124 and the convertible chamber 123 may be transposed in some embodiments. Consequently, the description set forth herein is for illustrative purposes only and is not intended to be limiting in any aspect to any particular refrigerator chamber configuration.

Refrigerator doors 128 are each rotatably hinged to a corresponding edge of cabinet 102 for selectively accessing fresh food chamber 122. Similarly, freezer door 130 and convertible chamber door 131 are rotatably hinged to an edge of cabinet 102 in the illustrated example embodiment for selectively accessing freezer chamber 124 and convertible chamber 123. As another example, one or both of the freezer door 130 and the convertible chamber door 131 may instead be a front portion of a slidable drawer which can be selectively moved in and out of the respective chamber 123 and/or 124 along transverse direction T. To prevent leakage of cool air, the doors 128, 130, 131, and/or cabinet 102 may define one or more sealing mechanisms (e.g., rubber gaskets, not shown) at the interface where the doors 128, 130, 131 meet cabinet 102. Refrigerator doors 128, freezer door 130, and convertible chamber door 131 are shown in the closed configuration in FIG. 1 and in the open configuration in FIG. 2. It should be appreciated that doors having a different style, position, or configuration are possible and within the scope of the present subject matter.

In an exemplary embodiment, cabinet 102 also defines a mechanical compartment 60 at or near the bottom 106 of the cabinet 102 for receipt of a hermetically sealed cooling system configured for transporting heat from the inside of the refrigerator to the outside. One or more ducts may extend between the mechanical compartment 60 and the chilled chambers 122, 123, and/or 124 to provide fluid communication therebetween, e.g., to provide chilled air from the hermetically sealed cooling system, e.g., from an evaporator thereof, to one or more of the chilled chambers 122, 123, and/or 124. As is generally understood by those of skill in the art, the hermetically sealed system contains a working fluid, e.g., refrigerant, which flows between various heat exchangers of the sealed system where the working fluid changes phases. For example, the hermetically sealed system includes at least one evaporator where the working fluid absorbs thermal energy and changes from a liquid state to a gas state and at least one condenser where the working fluid releases thermal energy and returns to the liquid state from the gas state. As is understood, because the system is sealed, the working fluid is contained within the system and travels between the heat exchangers of the hermetically sealed system. A fan is typically provided at each heat exchanger of the sealed system. For example, a fan may force air across and around the at least one evaporator to transfer thermal energy from the air to the evaporator (and more particularly, to the working fluid therein), thereby generating a flow of chilled air which may be provided to one or more of the chilled chambers 122, 123, and/or 124. In some embodiments, some components of the sealed system may be located on different sides of a thermally insulated barrier, e.g., the at least one condenser may be positioned outside of the thermally insulated barrier with respect to the chilled chambers such that heat released from the working fluid as it condenses is directed away from the chilled chambers and to an ambient environment around the refrigerator appliance 100, and the at least one evaporator may be positioned on the same side of the thermally insulated barrier as the chilled chambers, whereby the flow of chilled air from the evaporator(s) to the chilled chambers may be entirely contained within a thermally insulated enclosure.

Refrigerator appliance 100 also includes a dispensing assembly 132 for dispensing liquid water and/or ice. Dispensing assembly 132 includes a dispenser 134 positioned on or mounted to an exterior portion of refrigerator appliance 100, e.g., on one of refrigerator doors 128. Dispenser 134 includes a discharging outlet 136 for accessing ice and liquid water. An actuating mechanism 138, shown as a paddle, is mounted below discharging outlet 136 for operating dispenser 134. In alternative exemplary embodiments, any suitable actuating mechanism may be used to operate dispenser 134. For example, dispenser 134 can include a sensor (such as an ultrasonic sensor) or a button rather than the paddle. A control panel 140 is provided for controlling the mode of operation. For example, control panel 140 includes a plurality of user inputs (not labeled), such as a water dispensing button and an ice-dispensing button, for selecting a desired mode of operation such as crushed or non-crushed ice.

Discharging outlet 136 and actuating mechanism 138 are an external part of dispenser 134 and are mounted in a dispenser recess 142. Dispenser recess 142 is positioned at a predetermined elevation convenient for a user to access ice or water and enabling the user to access ice without the need to bend-over and without the need to open refrigerator doors 128. In the exemplary embodiment, dispenser recess 142 is positioned at a level that approximates the chest level of an adult user. According to an exemplary embodiment, the dispensing assembly 132 may receive ice from an icemaker disposed in a sub-compartment of the fresh food chamber 122.

Refrigerator appliance 100 further includes a controller 144. Operation of the refrigerator appliance 100 is regulated by controller 144 that is operatively coupled to control panel 140. In some exemplary embodiments, control panel 140 may represent a general purpose I/O ("GPIO") device or functional block. In some exemplary embodiments, control panel 140 may include input components, such as one or more of a variety of electrical, mechanical or electro-mechanical input devices including rotary dials, push buttons, touch pads, and touch screens. Control panel 140 can be communicatively coupled with controller 144 via one or more signal lines or shared communication busses. Control panel 140 provides selections for user manipulation of the operation of refrigerator appliance 100, e.g., whereby a user may provide one or more set point temperatures for the various compartments 122, 123, and 124. In response to user manipulation of the control panel 140, controller 144 operates various components of refrigerator appliance 100. For example, controller 144 is operatively coupled or in communication with various airflow components, e.g., dampers and fans, as discussed below. Controller 144 may also be communicatively coupled with a variety of sensors, such as, for example, chamber temperature sensors or ambient temperature sensors. Such chamber temperature sensors and/or ambient temperature sensors may be or include thermistors, thermocouples, or any other suitable temperature sensor. Controller 144 may receive signals from these temperature sensors that correspond to the temperature of an atmosphere or air within their respective locations.

Controller 144 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 144 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. The controller 144 may be positioned in a variety of locations throughout refrigerator appliance 100. In the illustrated embodiment, the controller 144 is located within a control panel area 140 of one of the refrigerator doors 128, as shown in FIG. 1. In other example embodiments, the controller 144 may be positioned at or near the rear side 114 and/or the bottom 106 of the refrigerator appliance 100.

Figure 2:
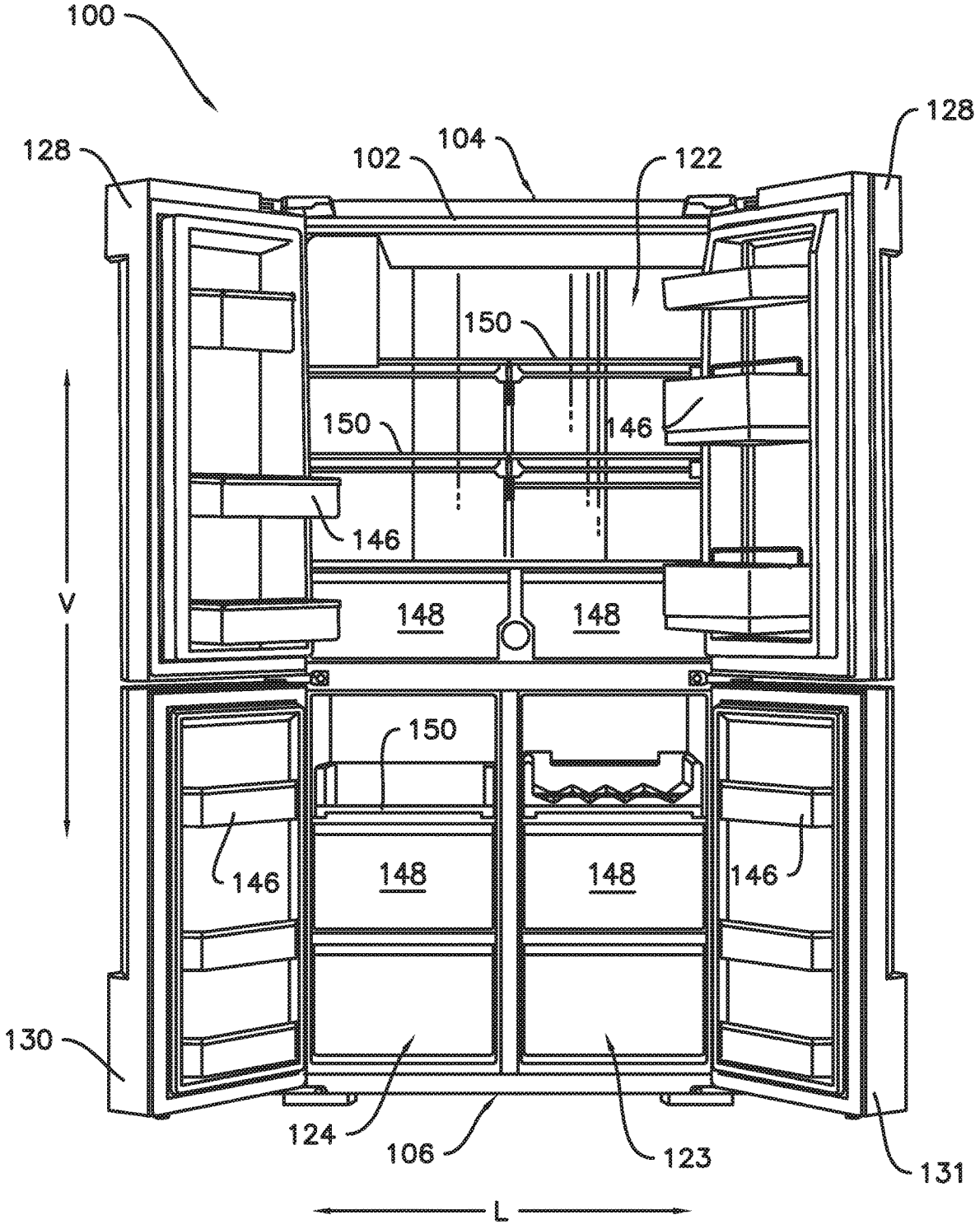
FIG. 2 provides a front view of the exemplary refrigerator appliance of FIG. 1 with the refrigerator and freezer doors of the refrigerator appliance shown in an open position.

FIG. 2 provides a front view of refrigerator appliance 100 with refrigerator doors 128, freezer door 130, and convertible chamber door 131 shown in an open position. According to the illustrated embodiment, various storage components are mounted within fresh food chamber 122, convertible chamber 123, and freezer chamber 124 to facilitate storage of food items therein as will be understood by those skilled in the art. In particular, the storage components include bins 146, drawers 148, and shelves 150 that are mounted within fresh food chamber 122, convertible chamber 123, or freezer chamber 124. Bins 146, drawers 148, and shelves 150 are configured for receipt of food items (e.g., beverages and/or solid food items) and may assist with organizing such food items. As an example, drawers 148 of fresh food chamber 122 can receive fresh food items (e.g., vegetables, fruits, and/or cheeses) and increase the useful life of such fresh food items.

Figure 3:
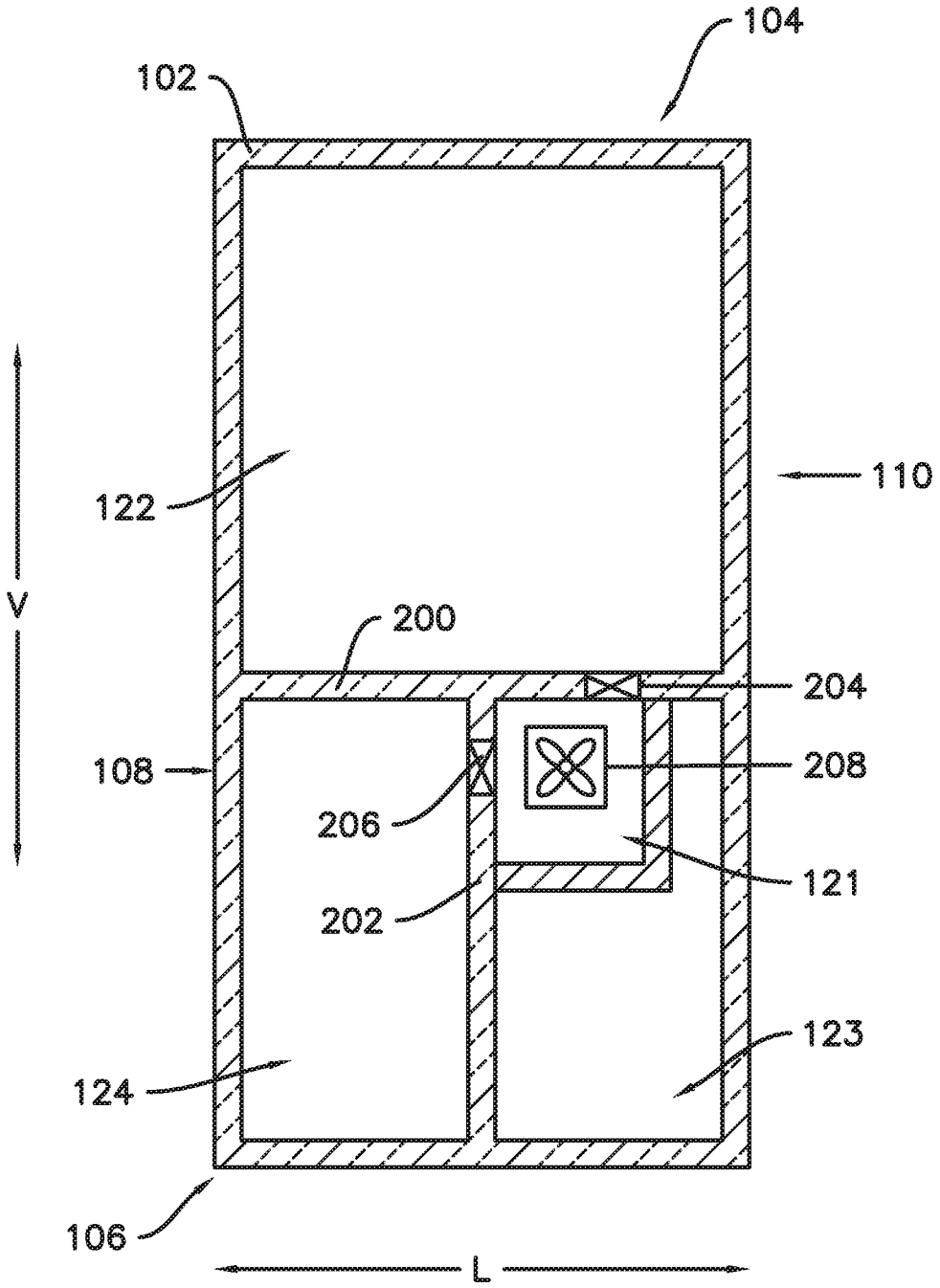
FIG. 3 provides a front sectional view of the exemplary refrigerator appliance of FIG. 1.
Figure 4:
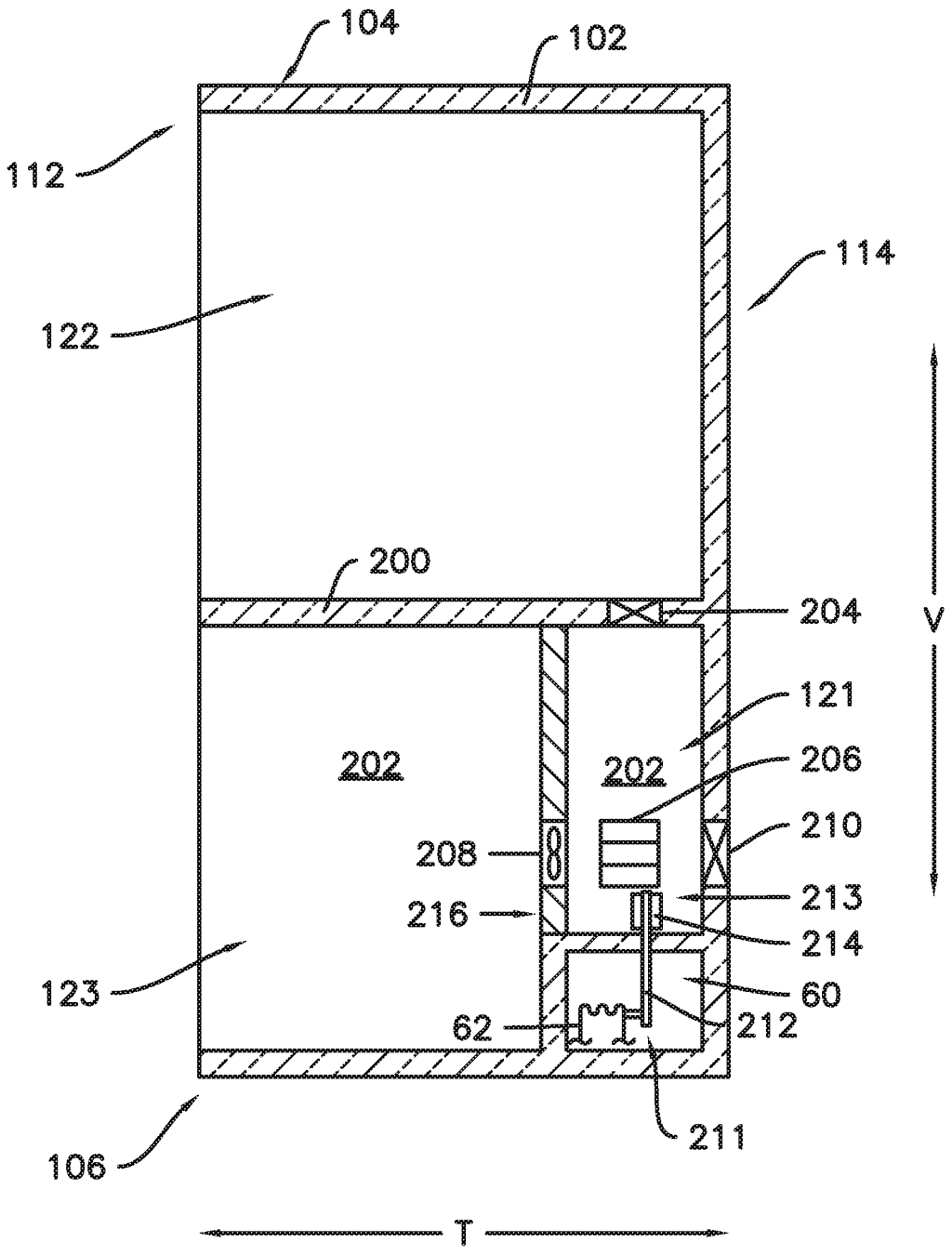
FIG. 4 provides a side sectional view of the exemplary refrigerator appliance of FIG. 1.

Turning now to FIGS. 3 and 4, FIG. 3 provides a front sectional view of refrigerator appliance 100 according to one or more exemplary embodiments and FIG. 4 provides a side sectional view of the exemplary refrigerator appliance. As shown, the cabinet 102 may be insulated in order to assist with thermally insulating the cabinet 102, and in particular the chilled chambers 122, 123, and 124 therein, from an ambient environment, e.g., room temperature. Any suitable insulation may be provided, e.g., an expandable foam, vacuum panels, or any other suitable thermally insulating material or combination of materials. Also as may be seen in FIGS. 3 and 4, the refrigerator appliance 100 may include a plurality of insulated mullions, e.g., a first insulated mullion 200 and a second insulated mullion 202. The first and second mullions 200 and 202 cooperate with an interior surface of the cabinet 102 to define the fresh food chamber 122, the convertible chamber 123, and the freezer chamber 124, as well as to thermally insulate the chambers 122, 123, and 124 from each other, e.g., to limit heat transfer between and among fresh food chamber 122, freezer chamber 124, and convertible chamber 123, such that the chambers may be independently operable at diverse temperatures.

As may be seen in FIG. 3, the first insulated mullion 200 extends along the lateral direction L from the left side 108 of the cabinet 102 to the right side 110 of the cabinet 102. As may be seen in FIG. 4, the first insulated mullion 200 extends along the transverse direction T from the front side 112 of the cabinet to the rear side 114 of the cabinet 102. As may be seen in each of FIGS. 3 and 4, the first insulated mullion 200 extends along the vertical direction V between the fresh food chamber 122 and the freezer chamber 124, such that the first insulated mullion 200 separates the fresh food chamber 122 from the freezer chamber 124 and the convertible chamber 123 and partially defines each of the chambers 122, 123, and 124.

As may be seen in FIG. 3, the second insulated mullion 202 extends along the lateral direction L between the freezer chamber 124 and the convertible chamber 123. As may be seen in FIG. 4, the second insulated mullion 202 extends along the transverse direction T from the front side 112 of the cabinet 102 to the rear side 114 of the cabinet 120. As may be seen in each of FIGS. 3 and 4, the second insulated mullion 202 extends along the vertical direction V coextensively with the freezer chamber 124 and the convertible chamber 123. Thus, the second insulated mullion 202 separates and partially defines the freezer chamber 124 and the convertible chamber 123.

As best seen in FIG. 3, in some embodiments, the fresh food chamber 122 may extend along the vertical direction V between the top 104 and the bottom 106 of the cabinet 102, e.g., from at or near the top 104 of the cabinet 102 to the first insulated mullion 200. The fresh food chamber 122 may extend along the lateral direction L from at or near the left side 108 to at or near the right side 110 of the cabinet 102. In some embodiments, the freezer chamber 124 may extend along the vertical direction V between the top 104 and bottom 106 of the cabinet 102, e.g., from at or near the bottom 106 of the cabinet 102 to the first insulated mullion 200. The freezer chamber 124 may also extend along the lateral direction L between the left side 108 and the right side 110 of the cabinet 102, e.g., from at or near the left side 108 to the second insulated mullion 202. Also as may be seen in FIG. 3, the convertible chamber 123 extends along the vertical direction V between the top 104 and the bottom 106 of the cabinet 102, e.g., from at or near the bottom 106 of the cabinet 102 to the first insulated mullion 200. As may be seen in FIG. 3, the convertible chamber 123 extends along the lateral direction L between the left side 108 and right side 110 of the cabinet 102, e.g., from at or near the right side 110 to the second insulated mullion 202. In various embodiments, the freezer chamber 124 may be spaced apart from the fresh food chamber 122 along the vertical direction V and separated by the first insulated mullion 200, e.g., the freezer chamber 124 may be positioned below the fresh food chamber 122, as in the illustrated examples. As mentioned above, the freezer chamber 124 may also be positioned above the fresh food chamber 122, e.g., a top mount configuration, and other configurations may also be provided, e.g., a side by side configuration, and/or the freezer chamber 124 and the convertible chamber 123 may be transposed along the lateral direction L.

As shown in FIG. 3, the refrigerator appliance 100 may include a plenum 121 with a fan 208. As shown in FIG. 4, the plenum 121 may be behind the convertible chamber 123, e.g., along the transverse direction T, and/or positioned at a back portion of the convertible chamber 123, such that the convertible chamber 123 is closer to the front 112 of the cabinet 102 and the plenum 121 is closer to the rear 114 of the cabinet. The plenum 121 may be housed within the convertible chamber 123, e.g., as shown in FIG. 3, the plenum 121 may be surrounded by the convertible chamber 123 on at least two sides. It is recognized that the accompanying drawings, e.g., FIGS. 3 and 4, are not necessarily drawn to scale and are provided merely to illustrate example configurations. For example, the volume of the plenum 121 relative to the volume of the convertible chamber 123 as illustrated in FIG. 4 is enlarged for clarity to illustrate certain details, such as the dampers and thermosiphon which will be more fully described below. In at least some embodiments, the volume of the plenum 121 may be relatively small as compared to the volume of the convertible chamber 123, e.g., the plenum 121 may be a small box in a corner, such as the upper left corner, of the convertible chamber 123. In some embodiments, the convertible chamber 123 may be spaced apart from the fresh food chamber 122 along the vertical direction V and spaced apart from the freezer chamber 124 along the lateral direction L. Thus, the convertible chamber 123 may be above or below the fresh food chamber 122, similar to the freezer chamber 124, as described above.

The fan 208 may be disposed between the convertible chamber 123 and the plenum 121. In various embodiments, the fan 208 may be a single speed fan or a variable speed fan. The fan 208 may be configured to force air from the plenum 121 into the convertible chamber 123. For example, the fan 208 may be positioned within a wall 216 which separates the convertible chamber 123 from the plenum 121, as illustrated in FIGS. 3 and 4. In other embodiments, the fan 208 may be mounted on either side of the wall 216, such that the fan 208 may be positioned in one or the other of the convertible chamber 123 and the plenum 121, where the fan 208 will be disposed between the convertible chamber 123 and the plenum 121 at least with respect to a flow of air between the convertible chamber 123 and the plenum 121, e.g., from the plenum 121 to the convertible chamber 123.

The plenum 121 may provide air to the convertible chamber 123 at a desired temperature according to, e.g., a user-selected temperature setting or set point temperature which may be received from control panel 140 and/or controller 144. For example, a first damper 204 may be configured to selectively provide fluid communication between the fresh food chamber 122 and the plenum 121 and a second damper 206 may be configured to selectively provide fluid communication between the freezer chamber 124 and the plenum 121. For example, each of the dampers 204 and 206 may be movable between an open position which permits fluid communication, e.g., air flow, and a closed position which restricts or prevents fluid communication, e.g., air flow. As may be seen in FIGS. 3 and 4, the first damper 204 may be positioned in the first insulated mullion 200 between the fresh food chamber 122 and the plenum 121, e.g., the first damper 204 may be positioned above the plenum 121 along the vertical direction V. The second damper 206 may be positioned in the second insulated mullion 202 between the freezer chamber 124 and the plenum 121. Accordingly, the convertible chamber 123 may be operated at about fresh food storage temperatures by opening the first damper 204 and closing the second damper 206, such that the fan 208 may provide air to the convertible chamber 123 that is about the same temperature as the fresh food chamber 122, and the convertible chamber 123 may be operated at about freezer temperatures by closing the first damper 204 and opening the second damper 206, such that the fan 208 may provide air to the convertible chamber 123 that is about the same temperature as the freezer chamber 124. Thus, the convertible chamber 123 is a "convertible" chamber in that the chamber 123 is adjustable at least between freezer temperatures and relatively warm temperatures, e.g., fresh food storage temperatures or above.

In at least some embodiments, the first damper 204 and the second damper 206 may be adjustable over a range of positions between the open position and the closed position. In such embodiments, the convertible chamber 123 may be operable over a range of temperatures by adjusting the air flow rate into the plenum 121 from each of the fresh food chamber 122 and the freezer chamber 124, e.g., the first damper 204 may be fully opened and the second damper 206 may be partially opened, e.g., half opened, one quarter opened, etc., such that the convertible chamber 123 may be operated at a temperature less than the fresh food chamber 122 and greater than the freezer chamber 124. In other examples, both dampers 204 and 206 may be partially opened and various other combinations of damper positions are also possible. For example, the position of the dampers 204 and 206 may be controlled by a pulse width modulation signal, whereby the dampers 204 and 206 may be moved from the open position to the closed position and vice versa, including various positions therebetween, over time in order to achieve a set point temperature between the temperature of the fresh food chamber 122 and the temperature of the freezer chamber 124, and/or, in at least some embodiments, a set point temperature above the temperature of the fresh food chamber 124, as described in more detail below.

For example, the temperature of the fresh food chamber 122 may be within a range between approximately thirty-four degrees Fahrenheit (34° F.) and approximately forty-two degrees Fahrenheit (42° F.), such as about thirty-seven degrees Fahrenheit (37° F.). Also by way of example, the temperature of the freezer chamber 124 may be within a range between approximately negative six degrees Fahrenheit (−6° F.) and approximately six degrees Fahrenheit (6° F.), such as about zero degrees Fahrenheit (0° F.). It should be understood that fresh food chamber 122 and freezer chamber 124 may be selectively operable at any number of various temperatures and/or temperature ranges as desired or required per application. Accordingly, by varying the position of the first and second dampers 204 and 206, e.g., between and including the open and closed positions as described above, the convertible chamber 123 may be operable within a range of temperatures between approximately negative six degrees Fahrenheit (−6° F.) and approximately forty-two degrees Fahrenheit (42° F.).

As mentioned above, the refrigerator appliance 100 includes a sealed system and the sealed system includes at least one evaporator configured to generate a flow of chilled air, e.g., by transferring heat from the air to the working fluid within the sealed system, as described above. In at least some embodiments, the refrigerator appliance 100 may include two evaporators, a first evaporator in fluid communication with the fresh food chamber 122, e.g., a fresh food evaporator, and a second evaporator in fluid communication with the freezer chamber 124, e.g., a freezer evaporator. The refrigerator appliance 100 may not include an evaporator dedicated to the convertible chamber 123, rather, the convertible chamber 123 may be selectively cooled by one or both of the fresh food evaporator and the freezer evaporator by opening one or both of the dampers 204 and 206. For example, when the first damper 204 is open, chilled air may flow from the fresh food evaporator to the fresh food chamber 122 and from the fresh food chamber 122 to the convertible chamber 123 via the plenum 121 and first damper 204. Similarly, and as another example, when the second damper 206 is open, chilled air may flow from the freezer evaporator to the freezer chamber 124 and from the freezer chamber 124 to the convertible chamber 123 via the plenum 121 and second damper 206. Thus, the refrigerator appliance 100 may include only two evaporators and a three-way valve to selectively direct a flow of liquid working fluid to the fresh food evaporator and/or the freezer evaporator. Accordingly, the plenum 121 disclosed herein may provide a convertible chamber 123 without requiring an additional evaporator or a four-way valve in the sealed system of the refrigerator appliance 100. Not including a dedicated evaporator for the convertible chamber 123 reduces the overall complexity of the refrigerator appliance 100 in several ways. For example, a defrost heater for the convertible chamber 123 is not required and plumbing to drain meltwater generated by operation of the defrost heater may also be omitted.

In some embodiments, it may be desirable to raise the temperature of the convertible chamber 123 above the temperatures of the freezer chamber 124 and the fresh food chamber 122. For example, in some instances, it may be desirable to raise the temperature of convertible chamber 123 such that it may reach and maintain relatively high temperatures, e.g., up to about 60° F. For example, a temperature of about 55° F. within convertible chamber 123 may be useful for storing certain wines and other food items. As another example, a temperature of about 43° F. within convertible chamber 123 may be useful for storing citrus fruits and other food items.

As illustrated for example in FIG. 4, in some embodiments, the refrigerator appliance 100 may include a third damper 210 which may be configured to selectively provide fluid communication between the plenum 121 and an ambient environment around the refrigerator appliance 100. For example, the refrigerator appliance 100 may be usable in an interior room inside a building, such as a kitchen, where the ambient environment around the refrigerator appliance 100 may be at room temperature, e.g., between approximately sixty-five degrees Fahrenheit (65° F.) and approximately eighty-five degrees Fahrenheit (85° F.), such as about seventy-five degrees Fahrenheit (75° F.). Thus, in such embodiments, room temperature air may be provided to the convertible chamber 123 via the plenum 121 by opening the third damper 210. Accordingly, the convertible chamber 123 may be operable at a temperature above the temperatures of the freezer chamber 124 and the fresh food chamber 122.

In some embodiments, the first damper 204, the second damper 206, and the third damper 210 may be operatively coupled with the controller 144. When a user selects a set point temperature indicative of a freezer temperature, controller 144 can send one or more signals and the dampers 204, 206, and 210, and/or one or more actuators connected thereto, can receive the one or more signals to open the second damper 206. Based at least in part on these signals, the second damper 206 can be articulated to the open position, thereby allowing cold air (e.g., air within the above-described freezer temperature range) to flow into the convertible chamber 123. In contrast, when a user selects a set point temperature indicative of a temperature warmer than the freezer temperature (e.g., a relatively high temperature of 55° F. or a fresh food temperature of 37° F.), controller 144 can send one or more signals and the dampers 204, 206, and 210 can receive the one or more signals to close (or partially close, in at least some embodiments, depending on the set point temperature selected) the second damper 206 and at least partially open one or both of the first damper 204 and the third damper 210. As a result, cold air flow into the convertible chamber 123 is reduced or ceases, while cool air (e.g., air within the above-described fresh food temperature range) and/or room temperature air may flow into the convertible chamber 123, thereby allowing the convertible chamber 123 to be warmed to the set point temperature.

In some embodiments, for example as illustrated in FIG. 4, the refrigerator appliance 100 may also include a thermosiphon 212 for operating the convertible chamber 123 at a warmer temperature, instead of or in addition to the third damper 210. For example, the thermosiphon 212 may be a single-phase heat exchanger, or may be a phase-change heat exchanger, which may also be referred to as a heat pipe. In some embodiments, an additional fan may be provided proximate the thermosiphon 212 and configured to provide forced convection and an increased heat transfer rate. As mentioned above, the refrigerator appliance may include a mechanical compartment 60 with a sealed system therein. The thermosiphon 212 may be configured to provide thermal communication between the sealed system and the convertible chamber 123, e.g., via the plenum 121. For example, the sealed system may include a condenser 62, e.g., a refrigerator condenser 62, and the thermosiphon 212 may extend from the condenser 62 to the plenum 121. As illustrated for example in FIG. 4, the thermosiphon 212 may extend from a first end 211 to a second end 213. The first end 211 of the thermosiphon 212 may be directly connected to the condenser 62 and the second end 213 of the thermosiphon 212 may be positioned in the plenum 121. In some embodiments, the thermosiphon 212 may include a plurality of fins 214, e.g., at the second end 213 positioned in the plenum 121, to provide or enhance thermal transfer from the thermosiphon 212 to the air in the plenum 121, and the air may then be forced into the convertible chamber 123 by the fan 208.

As mentioned above, the convertible chamber 123 may be operable within a range of temperatures between approximately negative six degrees Fahrenheit (−6° F.) and approximately forty-two degrees Fahrenheit (42° F.). The operating temperature of the convertible chamber 123 may be determined by a temperature setting, e.g., a user-selected set point temperature, which may be received by the controller 144, as described above. Embodiments of the present disclosure may include methods of operating a refrigerator appliance such as the exemplary method 300 illustrated in FIG. 5. For example, the controller 144 may be operable to perform some or all of the steps of the method 300. As mentioned, the method 300 may include a step 310 of receiving user inputs. Such user inputs may include one or more temperature settings, e.g., set points, for the chilled chambers 122, 123, and 124. For example, the user inputs may include a set point temperature for the fresh food chamber 122, a set point temperature for the freezer chamber 124, and a set point temperature for the convertible chamber 123. In some embodiments, the user inputs may also optionally include one or more additional settings, such as settings related to ice and/or water dispensing, or special modes such as a rapid cooling mode. For example, the controller 144 may receive the user inputs, e.g., set point temperatures, from the control panel 140.

Method 300 may also include a step 320 of measuring or determining the temperatures of the chilled chambers 122, 123, and 124. For example, such measurement may be made using chamber temperature sensors, e.g., thermocouples, as mentioned above. The measured chamber temperatures from step 320 may then be compared with the chamber set point temperatures and when, as shown at step 330, the measured temperature of the convertible chamber is above the convertible chamber set point temperature, the method 300 may proceed to open one or more dampers, such as one or more of the first, second, and third dampers 204, 206, and 210 described above, depending on the convertible chamber temperature, which may be either one or both of the set point temperature or the measured temperature of the convertible chamber. For example, which damper(s) are opened may depend on where the convertible chamber temperature falls within a range or set of ranges of temperature values, as described below. When the method 300 does not determine that the measured temperature of the convertible chamber exceeds the convertible chamber set point, then normal operation of the refrigerator appliance 100 may continue. The continuation of normal operation in accordance with the present disclosure is generally continuance of operation of the refrigerator appliance 100 in accordance with the present settings, with no adjustments in accordance with the present method.

The method 300 may include a step 340 of comparing the convertible chamber temperature, e.g., the convertible chamber set point temperature and/or the measured temperature of the convertible chamber 123, to the fresh food chamber temperature. When the convertible chamber temperature is within a first range, for example in the illustrated embodiment of FIG. 5, when the convertible chamber temperature is greater than the fresh food temperature, the method 300 may include a step 350 of opening the first damper 204 to provide fluid communication from the fresh food chamber 122 to the convertible chamber 123. For example, the first range may be the fresh food temperature range described above, e.g., between approximately thirty-four degrees Fahrenheit (34° F.) and approximately forty-two degrees Fahrenheit (42° F.), etc. In some embodiments, the temperature of the fresh food chamber 122 may be about thirty-seven degrees Fahrenheit (37° F.), such that the first range may be greater than about thirty-seven degrees Fahrenheit (37° F.), such as between about thirty-seven degrees Fahrenheit (37° F.) and about forty-two degrees Fahrenheit (42° F.).

Figure 5:
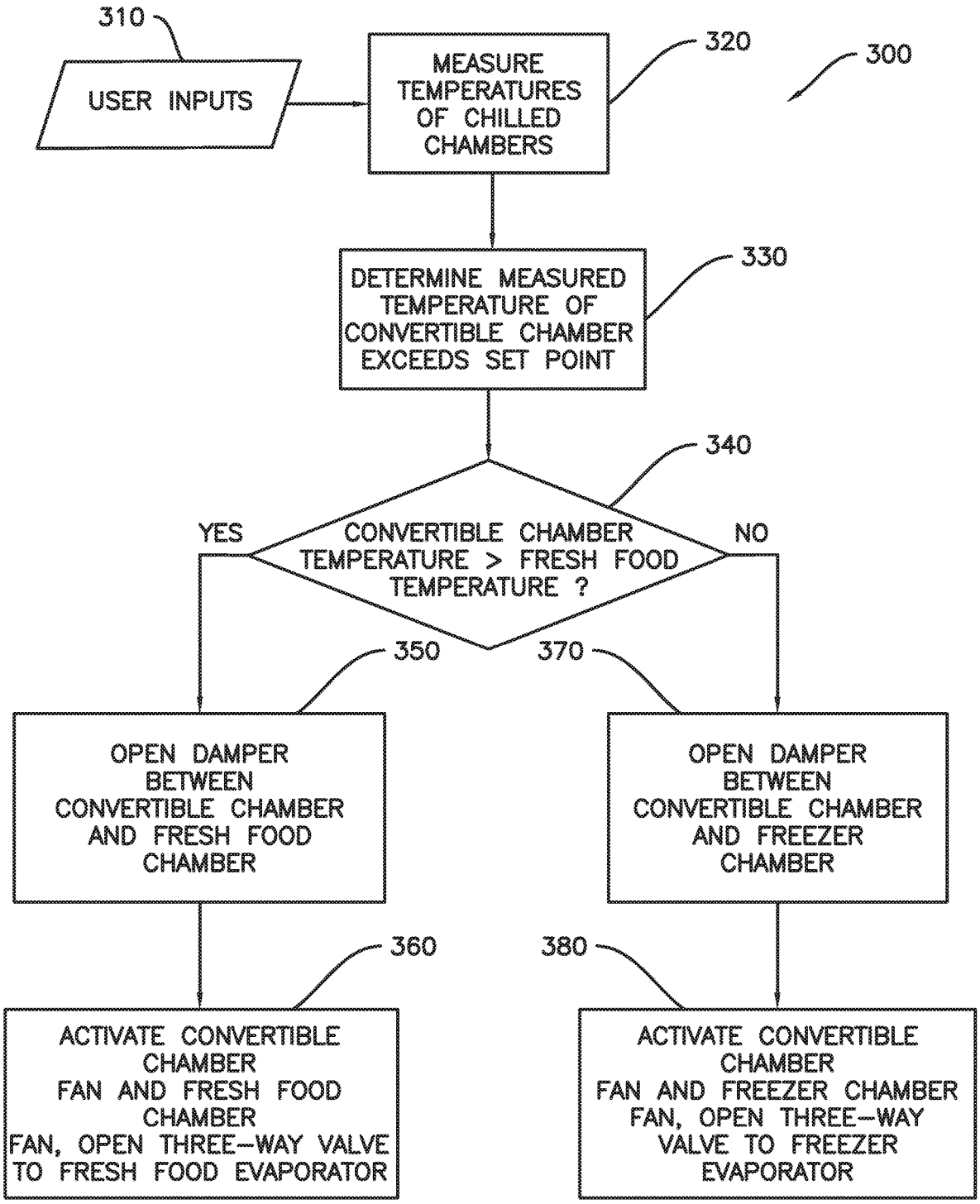
FIG. 5 provides a flow chart illustrating exemplary methods of operating a refrigerator appliance according to an exemplary embodiment of the present subject matter.

After opening the first damper 204 at step 350, the method 300 may further include a step 360, as illustrated in FIG. 5, which comprises cooling the fresh food chamber 122 and the convertible chamber 123. As shown, step 360 may include activating a convertible chamber fan, such as fan 208, to force air from the plenum 121 into the convertible chamber 123, activating a fresh food chamber fan, e.g., to force air about a fresh food evaporator of the sealed system, and opening a three-way valve of the sealed system to provide a flow of liquid refrigerant in the sealed system to the fresh food evaporator, such that the liquid refrigerant may absorb thermal energy from the air urged about the fresh food evaporator by the fresh food fan, as will be understood by those of skill in the art. Additionally, a compressor of the sealed system may be activated during all or part of the step 360, as will be understood by those of skill in the art.

When the convertible chamber temperature is within a second range, e.g., is less than the fresh food temperature, the method 300 may include a step 370 of opening the second damper 206 to provide fluid communication from the freezer chamber 124 to the convertible chamber 123. For example, the second range may be or include the freezer temperature range described above, e.g., between approximately negative six degrees Fahrenheit (−6° F.) and approximately six degrees Fahrenheit (6° F.), etc. In some embodiments, the second range may include any temperature within the operating range of the refrigerator appliance 100 below the first range, e.g., the second range may be between approximately negative six degrees Fahrenheit (−6° F.) and approximately thirty-three degrees Fahrenheit (33° F.).

After opening the second damper 206 at step 370, the method 300 may further include a step 380, as illustrated in FIG. 5, which comprises cooling the freezer food chamber 124 and the convertible chamber 123. As shown, step 380 may include activating a convertible chamber fan, such as fan 208, to force air from the plenum 121 into the convertible chamber 123, activating a freezer chamber fan, e.g., to force air about a freezer evaporator of the sealed system, and opening a three-way valve of the sealed system to provide a flow of liquid refrigerant in the sealed system to the freezer evaporator, such that the liquid refrigerant may absorb thermal energy from the air urged about the freezer evaporator by the freezer fan, as will be understood by those of skill in the art. Additionally, a compressor of the sealed system may be activated during all or part of the step 380, as will be understood by those of skill in the art.

Thus, method 300 may also include at least partially opening one or both the first damper 204 and the second damper 206, as described above, when the temperature setting is between the fresh food temperature range and the freezer temperature range. For example, method 300 may include, and the controller 144 may be configured for, selecting the coldest possible source air for a given temperature setting. For example, when the temperature setting is within the second range and is also greater than the current operating temperature of the freezer chamber 124, the method 300 may include partially opening the second damper 206 while the first damper 204 may be closed.

In some embodiments, the method 300 may further include determining whether the respective source chamber, e.g., the fresh food chamber 122 when the first damper 204 is open and/or the freezer chamber 124 when the second damper 206 is open, is actively cooling. For example, as mentioned above, the refrigerator appliance 100 may include a fresh food evaporator and a freezer evaporator such that determining whether the source chamber is active may include determining which, if any, of the fresh food evaporator and a freezer evaporator is active. Such determination may be based on, for example, a position of the three-way valve and/or a status of a compressor of the sealed system. For example, when the compressor is inactive, it may be determined that neither of the source chambers is actively cooling. Also by way of example, when the compressor is active and the three-way valve is in a first position to direct refrigerant to the fresh food evaporator, it may be determined that the fresh food chamber 122 is actively cooling, or when the compressor is active and the three-way valve is in a second position to direct refrigerant to the freezer evaporator it may be determined that the freezer chamber is actively cooling. Additionally, when the compressor is active and the three-way valve is in a third position to direct refrigerant to both the fresh food chamber 122 and the freezer chamber 124, it may be determined that both the fresh food chamber 122 and the freezer chamber 124 are actively cooling.

In some cases, the fresh food chamber 122 or freezer chamber 124 may not be actively cooling when there is a call for cooling the convertible chamber 123, e.g., when a temperature setting is received at step 310 that is lower than a current temperature of the convertible chamber 123 (e.g., which may be measured by an appropriate temperature sensor, as mentioned above). In such cases, the method may include delaying cooling of the convertible chamber 123 or may include activating cooling of one or both of the fresh food chamber 122 and the freezer chamber 124 in order to provide chilled air to the convertible chamber 123.

For example, in some embodiments, the method may include determining that the fresh food chamber 122 is actively cooling before opening the first damper 204 when the temperature setting is within the first range and determining that the freezer chamber is actively cooling before opening the second damper when the temperature setting is within the second range. Thus, cooling of the convertible chamber 123 may be delayed until the source chamber(s) are actively cooling.

As another example, the method may include activating the fan 208 only after determining the source chamber is actively cooling. For example, the method 300 may include determining whether the fresh food chamber is actively cooling and determining whether the freezer chamber is actively cooling. In such embodiments, the method 300 may further include activating the fan 208 to force air from the plenum 121 into the convertible chamber 123 after opening the first damper 204 when the fresh food chamber 122 is actively cooling and may include activating the fan 208 to force air from the plenum 121 into the convertible chamber 123 after opening the second damper 206 when the freezer chamber 124 is actively cooling.

In some embodiments, the method 300 may include activating cooling of one or both of the fresh food chamber 122 and the freezer chamber 124 in order to provide chilled air to the convertible chamber 123. For example, the method 300 may include determining whether the fresh food chamber is actively cooling when the temperature setting is within the first range and determining whether the freezer chamber is actively cooling when the temperature setting is within the second range. In such embodiments, the method 300 may further include activating cooling of the fresh food chamber when the temperature setting is within the first range and the fresh food chamber is not actively cooling and/or activating cooling of the freezer chamber when the temperature setting is within the second range and the freezer chamber is not actively cooling.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet extending from a top to a bottom along the vertical direction, from a left side to a right side along the lateral direction, and from a front side to a rear side along the transverse direction;

a fresh food chamber defined in the cabinet, the fresh food chamber extending along the vertical direction between the top and the bottom of the cabinet and along the lateral direction between the left and right sides of the cabinet;

a freezer chamber defined in the cabinet, the freezer chamber extending along the vertical direction between the top and bottom of the cabinet and along the lateral direction between the left and right sides of the cabinet, the freezer chamber spaced apart from the fresh food chamber along the vertical direction;

a convertible chamber defined in the cabinet, the convertible chamber extending along the vertical direction between the top and bottom of the cabinet and along the lateral direction between the left and right sides of the cabinet, the convertible chamber spaced apart from the fresh food chamber along the vertical direction and spaced apart from the freezer chamber along the lateral direction;

a heat exchanger system comprising a condenser, the heat exchanger system configured for transporting heat from the inside of the refrigerator to the outside;

a plenum defined in the cabinet, the plenum aligned with the convertible chamber along the vertical and lateral directions and spaced from the convertible chamber along the transverse direction, wherein no components of the heat exchanger system are disposed within the plenum;

a first insulated mullion extending along the lateral direction from the left side of the cabinet to the right side of the cabinet, extending along the transverse direction from the front side of the cabinet to the rear side of the cabinet, and extending along the vertical direction between the fresh food chamber and the freezer chamber, whereby the first insulated mullion separates the fresh food chamber from the freezer chamber and the convertible chamber and the first insulated mullion partially defines each of the fresh food chamber, the freezer chamber, and the convertible chamber;

a second insulated mullion extending along the lateral direction between the freezer chamber and the convertible chamber, along the transverse direction from the front side of the cabinet to the rear side of the cabinet, and extending along the vertical direction coextensively with the freezer chamber and the convertible chamber, whereby the second insulated mullion separates and partially defines the freezer chamber and the convertible chamber;

a first damper positioned in the first insulated mullion above the plenum along the vertical direction, the first damper configured to selectively provide direct fluid communication between the fresh food chamber and the plenum;

a second damper positioned in the second insulated mullion between the freezer chamber and the plenum, the second damper configured to selectively provide direct fluid communication between the freezer chamber and the plenum; and a fan disposed between the convertible chamber and the plenum, the fan configured to force air from the plenum into the convertible chamber, whereby the convertible chamber is selectively cooled by air from one or both of the fresh food chamber and the freezer chamber when the fan is activated while one or both of the first damper and the second damper is in an at least partially open position;

wherein the refrigerator appliance does not include an evaporator dedicated to the convertible chamber.

2. The refrigerator appliance of claim 1, further comprising a third damper configured to selectively provide fluid communication between the plenum and an ambient environment.

3. The refrigerator appliance of claim 1, further comprising a thermosiphon configured to provide thermal communication between the condenser of the heat exchanger system and the convertible chamber.

4. The refrigerator appliance of claim 3, wherein the thermosiphon extends from the condenser to the plenum.

5. The refrigerator appliance of claim 3, wherein the thermosiphon extends from a first end to a second end, the first end of the thermosiphon directly connected to the condenser and the second end of the thermosiphon positioned in the plenum.

6. A refrigerator appliance, comprising:

a cabinet comprising a plurality of insulated mullions, the insulated mullions at least partially defining a fresh food chamber, a freezer chamber, a convertible chamber, and a plenum;

a heat exchanger system comprising a condenser, the heat exchanger system configured for transporting heat from the inside of the refrigerator to the outside, wherein no components of the heat exchanger system are disposed within the plenum;

a first damper positioned in a first insulated mullion of the plurality of insulated mullions, the first insulated mullion separating the fresh food chamber from the freezer chamber and the convertible chamber and the first insulated mullion partially defining each of the fresh food chamber, the freezer chamber, and the convertible chamber, the first damper selectively providing direct fluid communication between the fresh food chamber and the plenum;

a second damper positioned in a second insulated mullion of the plurality of insulated mullions, the second insulated mullion separating and partially defining the freezer chamber and the convertible chamber, the second damper selectively providing direct fluid communication between the freezer chamber and the plenum; and a fan disposed between the convertible chamber and the plenum, the fan configured to force air from the plenum into the convertible chamber, whereby the convertible chamber is selectively cooled by air from one or both of the fresh food chamber and the freezer chamber when the fan is activated while one or both of the first damper and the second damper is in an at least partially open position;

wherein the refrigerator appliance does not include an evaporator dedicated to the convertible chamber.

7. The refrigerator appliance of claim 6, further comprising a third damper configured to selectively provide fluid communication between the plenum and an ambient environment.

8. The refrigerator appliance of claim 6, further comprising a thermosiphon configured to provide thermal communication between the condenser of the heat exchanger system and the plenum.

9. The refrigerator appliance of claim 8, wherein the thermosiphon extends from the condenser to the plenum.

10. The refrigerator appliance of claim 8, wherein the thermosiphon extends from a first end to a second end, the first end of the thermosiphon directly connected to the condenser and the second end of the thermosiphon positioned in the plenum.

11. A method of operating a refrigerator appliance, the refrigerator appliance comprising a cabinet with a plurality of insulated mullions, the insulated mullions at least partially defining a plenum, a fresh food chamber, a freezer chamber, and a convertible chamber in the cabinet, the refrigerator appliance further comprising a heat exchanger system comprising a condenser, the heat exchanger system configured for transporting heat from the inside of the refrigerator to the outside, wherein no components of the heat exchanger system are disposed within the plenum, wherein a first insulated mullion of the plurality of insulated mullions separates the fresh food chamber from the freezer chamber and the convertible chamber and partially defines each of the fresh food chamber, the freezer chamber, and the convertible chamber, wherein a second insulated mullion of the plurality of insulated mullions separates and partially defines the freezer chamber and the convertible chamber, and wherein the refrigerator appliance does not include an evaporator dedicated to the convertible chamber, the method comprising:

receiving a temperature setting for the convertible chamber;

opening a first damper positioned in the first insulated mullion to provide direct fluid communication from the fresh food chamber to the convertible chamber via the plenum when the temperature setting is within a first range;

opening a second damper positioned in the second insulated mullion to provide direct fluid communication from the freezer chamber to the convertible chamber via the plenum when the temperature setting is within a second range lower than the first range; and activating a fan disposed between the convertible chamber and the plenum, whereby the convertible chamber is selectively cooled by air from one or both of the fresh food chamber and the freezer chamber.

12. The method of claim 11, further comprising determining that the fresh food chamber is actively cooling before opening the first damper when the temperature setting is within the first range and determining that the freezer chamber is actively cooling before opening the second damper when the temperature setting is within the second range.

13. The method of claim 11, further comprising:

determining whether the fresh food chamber is actively cooling;

determining whether the freezer chamber is actively cooling;

activating the fan to force air from the plenum into the convertible chamber after opening the first damper when the fresh food chamber is actively cooling; and activating the fan to force air from the plenum into the convertible chamber after opening the second damper when the freezer chamber is actively cooling.

14. The method of claim 11, further comprising:

determining whether the fresh food chamber is actively cooling when the temperature setting is within the first range;

determining whether the freezer chamber is actively cooling when the temperature setting is within the second range;

activating cooling of the fresh food chamber when the temperature setting is within the first range and the fresh food chamber is not actively cooling; and activating cooling of the freezer chamber when the temperature setting is within the second range and the freezer chamber is not actively cooling.

* * * * *